US007948468B2

(12) United States Patent
Zane et al.

(10) Patent No.: US 7,948,468 B2
(45) Date of Patent: May 24, 2011

(54) SYSTEMS AND METHODS FOR DRIVING MULTIPLE SOLID-STATE LIGHT SOURCES

(75) Inventors: Regan A Zane, Superior, CO (US); Montu Doshi, Boulder, CO (US)

(73) Assignee: The Regents of the University of Colorado, Boulder, CO (US)

( * ) Notice: Subject to any disclaimer, the term of this patent is extended or adjusted under 35 U.S.C. 154(b) by 998 days.

(21) Appl. No.: 11/678,517

(22) Filed: Feb. 23, 2007

(65) Prior Publication Data

US 2008/0202312 A1 Aug. 28, 2008

(51) Int. Cl.
*G09G 3/36* (2006.01)

(52) U.S. Cl. ..... 345/102

(58) Field of Classification Search ..... 345/102
See application file for complete search history.

(56) References Cited

U.S. PATENT DOCUMENTS

2004/0001040 A1* 1/2004 Kardach et al. ..... 345/102
2006/0007110 A1* 1/2006 Hung et al. ..... 345/102
2007/0159750 A1* 7/2007 Peker et al. ..... 361/93.1

OTHER PUBLICATIONS

Doshi, Montu and Zane, Robert "Reconfigurable and Fault Tolerant Digital Phase Shifted Modulator for Luminance Control of LED Light Sources" IEEE, 2008, pp. 4185-4191.*
LP8543 Product Brief—SMBus/12C Controlled WLED Driver for Medium Sized LCD Backlight, National Semiconductor, Aug. 18, 2009.

* cited by examiner

*Primary Examiner* — Richard Hjerpe
*Assistant Examiner* — Andrew Schnirel
(74) *Attorney, Agent, or Firm* — Snell & Wilmer L.L.P.

(57) ABSTRACT

The present disclosure may relate generally to controlling multiple light sources and to systems and methods for reducing inefficiencies and interference in a light emitting diode (LED)-based backlighting systems for LCD televisions.

12 Claims, 7 Drawing Sheets

SYSTEMS AND METHODS FOR DRIVING MULTIPLE SOLID-STATE LIGHT SOURCES

GOVERNMENT CONTRACTS

The United States Government may have certain rights in this invention pursuant to Grant No. 0348772 awarded by the National Science Foundation.

BACKGROUND

Technical Field

The present disclosure may relate generally to controlling multiple light sources and, in particular, to systems and methods for reducing inefficiencies and interference in a light emitting diode (LED)-based backlighting systems for LCD televisions.

The emergence of high brightness light emitting diodes (HB-LEDs) may have improved aspects of solid state lighting solutions, which may provide performance advantages over conventional lighting technology. Higher optical efficiency, long operating lifetimes, wide operating temperature range and environmentally friendly implementation may be some of the key advantages of LED technology over incandescent or gas discharge light source solutions. However, manufacturing variations in forward voltage drop, luminous flux output, and/or peak wavelength may necessitate binning strategies, which may result in relatively lower yield and increased cost. Furthermore, a large number of LEDs, with matched characteristics, arranged in a suitable optical housing, may be required to meet the desired optical and luminance performance requirements. Dimming requirements and the need for circuit compensation techniques to regulate light output over a range of temperatures, and lifetime of the hardware may render a resistor biased drive solution obsolete for modern LED.

Various circuit techniques based on switching and linear regulating devices may have been described for driving a single "string" of series LEDs with precise forward current regulation and pulse modulation based dimming techniques. Such architectures may require a dedicated drive circuit for each LED string, and therefore may not be suitable for controlling a large number of strings.

SUMMARY

In accordance with various aspects of exemplary embodiments, a system and method may be described, which may include a single element control for both the power delivery, and a relatively deterministic load, which may be characterized by the current level and on/off state for each LED string. The system input may include a control input, which may include a dimming or light level command, which may be processed to provide coordinated responses by a converter and LED string current regulation. Inefficiencies may be reduced at least in part by performing phase shifted pulse width modulation (PS-PWM) of the LED strings, which may eliminate pulsed currents from the converter output, and may provide dynamic bus voltage regulation for improved efficiency. A hardware efficient digital circuit techniques may be utilized for phase shifting of the PWM drive signals to each parallel LED string. Dynamic bus voltage regulation may be achieved through feed-forward of load changes from the PS-PWM, active sensing of the required drive voltage for each LED string, and/or optimal sequencing of LED strings, and/or combinations thereof. The load may include the parallel strings.

BRIEF DESCRIPTION OF THE DRAWINGS

Claimed subject matter is particularly pointed out and distinctly claimed in the concluding portion of the specification. However, such subject matter may be understood by reference to the following detailed description when read with the accompanying drawings in which:

Figure 1:
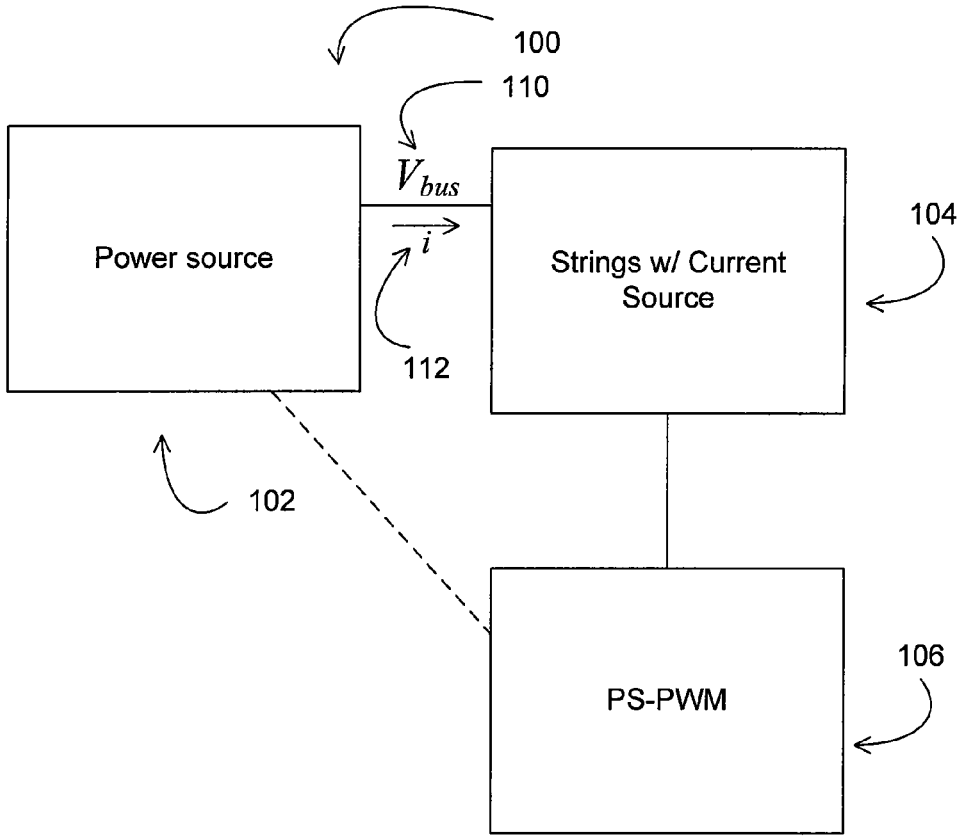
FIG. 1 is a block diagram of a system capable of controlling one or more light sources in accordance with one or more embodiments.

It will be appreciated that for simplicity and/or clarity of illustration, elements illustrated in the figures have not necessarily been drawn to scale. For example, the dimensions of some of the elements may be exaggerated relative to other elements for clarity. Further, if considered appropriate, reference numerals have been repeated among the figures to indicate corresponding and/or analogous elements.

DETAILED DESCRIPTION

In the following detailed description, numerous specific details are set forth to provide a thorough understanding of claimed subject matter. However, it will be understood by those skilled in the art that claimed subject matter may be practiced without these specific details. In other instances, well-known methods, procedures, components and/or circuits have not been described in detail.

One drawback to driving parallel LED strings from a single bus voltage may be that series elements are required in each string to block the difference between the string voltage and the bus voltage. In an embodiment, linear current sinks may be used for string current regulation and to block the required voltage. One approach for selecting the bus voltage may be to preset a constant value based on the worst case maximum data sheet LED forward voltage drops. Since the power loss in each string is directly proportional to the difference between the bus voltage and the sum of the series LED string forward voltage drops, a worst case design may result in over design of the power stage, and/or increased driver losses. In order to generally reduce inefficiencies of the power stage design, it may be useful to utilize the variations expected in forward voltage drop.

There may be large variations in voltage drop across relatively similar LEDs due at least in part to the manufacturing processes. Such large variations may be expected to continue as a design consideration. One approach, which may reduce the demands on the drive circuit is to perform binning of LEDs by optical and electrical characteristics, often resulting in an expensive three step process to bin first for wavelength, then for luminous output, and finally for forward voltage. An alternative to binning in the manufacturing process may be to make the circuit more capable of adapting efficiently to component variations. Dynamic bus voltage regulation may be one way to compensate for these variations. This may be accomplished at least in part by utilizing digital power stage control along with a PS-PWM to reduce the losses associated with driving a large array of unsorted/unbinned LEDs.

FIG. 1 is a block diagram of system 100 capable of controlling multiple light emitting diodes (LEDs), according to an embodiment. System 100 may include a power source 102 coupled to strings 104 with a current source. Furthermore, system 100 may include a phase-shifted pulse width modulator (PS-PWM) 106, also coupled to strings 104.

PS-PWM 106 may control the designation and/or activation of strings 104. The control outputs of PS-PWM 106 may include the instance when the time delays between each consecutive string turning on are relatively approximately equal. Strings 104 may include one or more parallel strings of at least one series LED or other light source. PS-PWM 106 may control the activation of the various strings, such that the strings may be activated one at a time to reduce in-rush current i 112. In one embodiment, instead of activating all strings at 40%, only 40% of the strings are activated at desired intensity, with the strings activated and rotated through, with only 40% of the strings activated during a time period. This may allow for nearly constant load at the power supply. With the lower in-rush current i 112, power to activate the strings 104 may be reduced, and EMI may also be reduced. This may decrease the pulse currents and create more uniform distribution of light. By spacing LEDs in manner suitable for the application, and utilizing PS-PWM, a relatively constant uniform light output may be achieved, in contrast to flashing of LEDs commonly done in conventional architectures.

Figure 2:
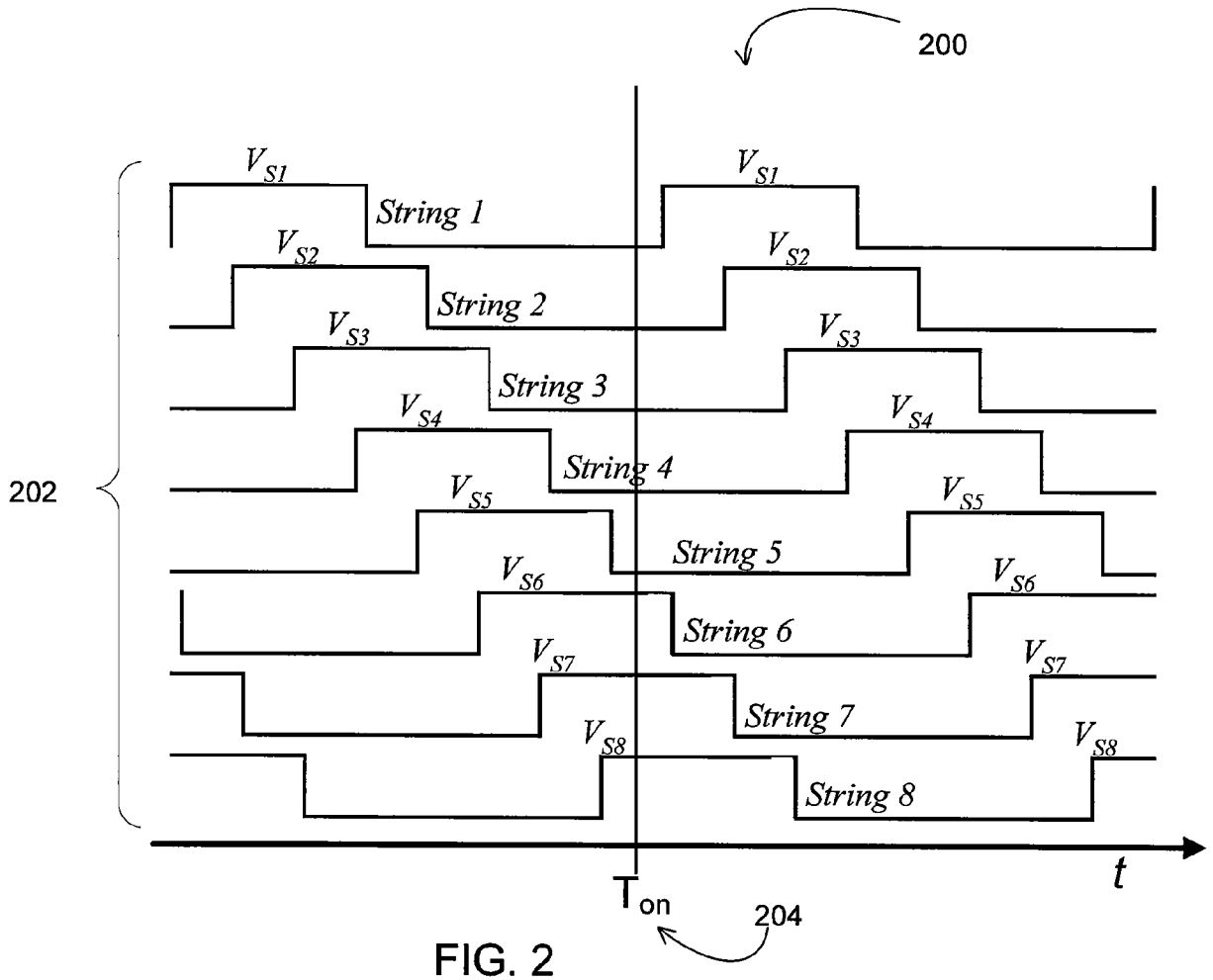
FIG. 2 is a graph of control voltages, which may be utilized in controlling one or more light sources in accordance with one or more embodiments.

FIG. 2 shows a timing diagram of control voltages from the PS-PWM for activating the various strings. In this embodiment, there are eight strings, however it will be appreciated that any number of strings may be utilized. The utilization of eight strings is merely for illustrative purposes. As can be seen, if an input command is applied to a PS-PWM, PS-PWM may activate the various strings via signal voltages 202. In this particular embodiment, the strings are activated in sequence, with an approximate 40% dim command, such that only 3 of 8 strings are activated at a discreet time $T_{on}$ 204. In this manner, a 40% dim command may be accomplished using a lower bus voltage and a lower in-rush current, as strings are not activated at the same time and/or only approximately 40% of the strings are activated full on, instead of all strings activated at 40%. This may reduce inefficiencies, in that $V_{bus}$ 110 voltage may not have to be kept a maximum level, and/or the in-rush current when strings are activated may be lessened.

The PS-PWM 106 may be capable of controlling the switching sequence and duty cycle of individual strings, which may include current sources, based on a digital dimming command (d bits) received from a microcontroller or color control ASIC. Then for N LED strings, the dimming command, Dim may be divided into n coarse quantization bits (most significant bits, MSB) and 'm' lower fine quantization bits (least significant bits, LSB), where 'n' and 'm' may be described at least in part by the equations:

$$N=2^n$$

and $$m=d-n$$

The PWM may utilize the MSB portion of the dimming level command to determine the number of strings that are active at any point in time. The modulator may rotate which strings are active, resulting in phase shifting of the LED string drive signals, which may respond relatively quickly to command inputs. The high-resolution LSB portion of the command may be added to the trailing edge of coarse pulses to achieve high resolution.

It can be seen that the individual outputs of the PS-PWM may be phase shifted and the dimming command input may be somewhat related to the number of phases that are on simultaneously, i.e. for 40% command at any given time three out of the eight outputs are 'on'. An advantage of the PS-PWM may be that the load current of the power stage has a peak-to-peak variation less than or equal to just one LED string current over the full range of dimming command. This is in contrast to the output current transients observed with a synchronized or time-delay based PWM, where the load current pulse amplitude is equal to N times one LED string current. The reduction in load current pulse amplitude may result in reduced converter component requirements, more efficient converter operation in continuous, discontinuous and pulsed operation modes over the dimming range, and/or a significant reduction in the size of the converter output capacitance, and/or combinations thereof. An additional benefit of lower current pulses may be a reduction in conducted and radiated EMI in the system.

Figure 3:
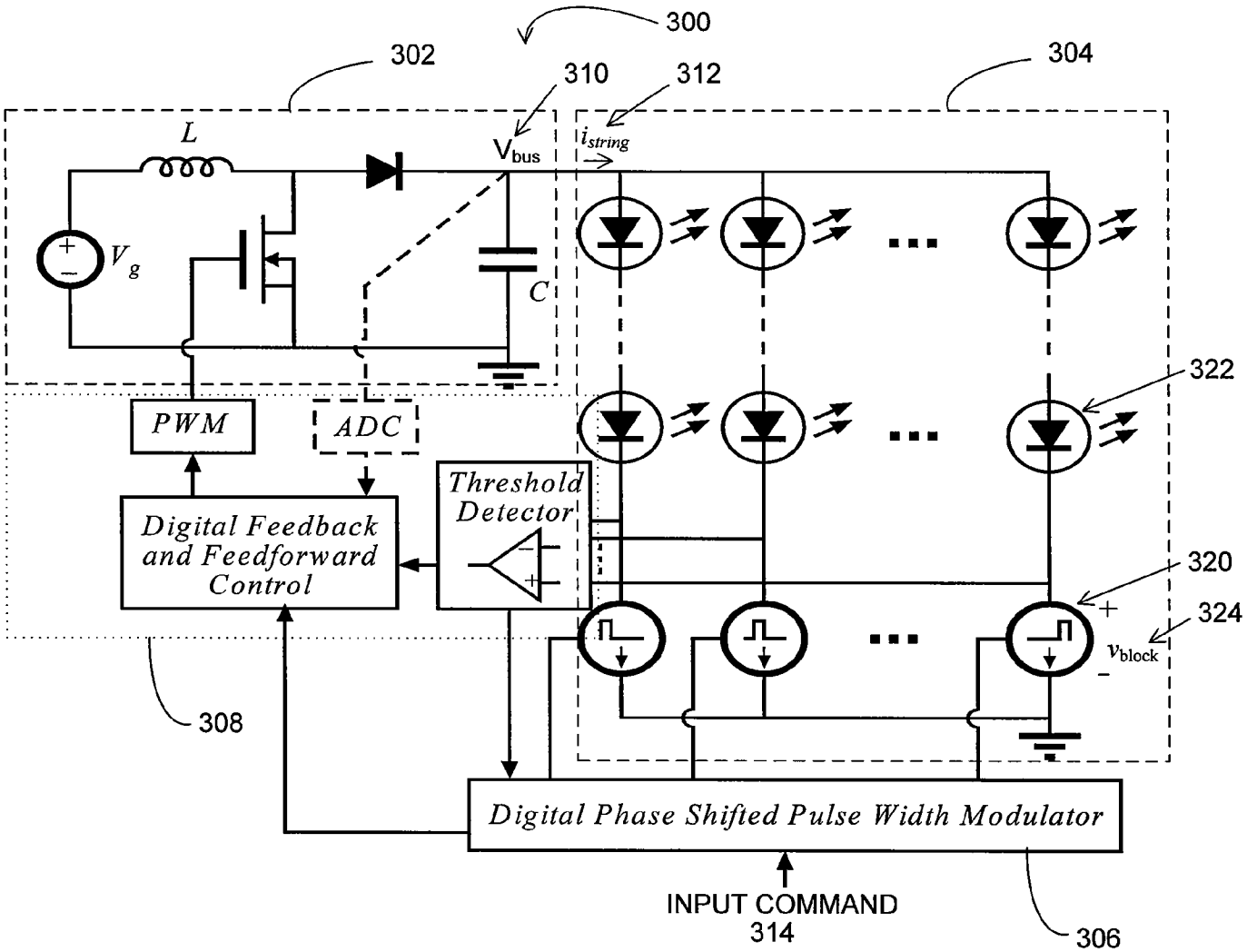
FIG. 3 is a circuit diagram of a system capable of controlling one or more light sources in accordance with one or more embodiments.

FIG. 3 is a system capable of controlling multiple LEDs, generally at 300. In an embodiment, system 300 may include a power source 302, coupled to strings 304. System 300 may also include a digital PS-PWM 306, which may also be coupled to strings 304, as well as to feed forward module 308. Feed forward module 308 may also be coupled to power source 302.

Strings 304 may include one or more series LEDs in parallel strings. In this embodiment, strings 304 may also include a linear current source 320, which may provide a sufficient current to LEDs to control the luminescence of LEDs 322. The voltage drop across each, individual string will vary with the individual characteristics of the LEDs, such that the different strings will have different activation voltages. If $V_{bus}$ 310 is kept at a higher level than needed for a particular string, the current source 320 may have to block some voltage, $v_{block}$ 324. Therefore, if $V_{bus}$ was kept near a relatively minimum level, $v_{block}$ 324 may be managed and inefficiencies may be reduced.

In this embodiment, a linear current source 320 is shown, however, other types of current sources, such as switching converters, may be utilized without straying from the concepts disclosed herein. PS-PWM 306 may control the activation of the various strings based, at least in part, upon input command 314. In the embodiment shown in FIG. 2 of a 40% dim command as input command 314, PS-PWM 306 may stagger the activation of strings. Therefore, PS-PWM 306 may control the designation and/or activation of strings 304 and may also be capable of feeding forward that information to the voltage supply 302, such that $V_{bus}$ 310 may be kept at a minimum level to activate the designated strings.

A relatively minimum level of voltage may be at or slightly above the minimum voltage to drive the designated strings. Furthermore, $i_{string}$ 312 may be reduced, in that not all strings may be activated at the same time, and/or in a staggered manner, such that the in-rush of current may be reduced.

In an embodiment, feed forward module 308 may include a sensing device, such as a threshold detector, which may measure changes in the voltage requirements for LED strings 304 dynamically, such that thermal characteristics and variations may be accounted for. It will be appreciated that, if a threshold detector is included, an analog to digital converter (ADC) may not be needed. Furthermore, since the in-rush current may be less, the size of capacitor C may be reduced, which may further reduce costs and inefficiencies of the overall system.

Therefore, since PS-PWM 306 may pass a signal to feed forward module 308, which may control power source 302, inefficiencies with $V_{bus}$ 310 and in-rush current may be reduced, thereby improving the efficiency of the overall system. This is one embodiment of a power source 302. It will be appreciated that other configurations for a power source may be utilized without straying from the concepts herein. Furthermore, this is also one embodiment of a feed forward module 308. It will be appreciated that other configurations for a feed forward module may be utilized without straying from the concepts herein.

Threshold detector may also make it possible to measure the voltage drop across the individual strings, such that particular strings with similar activation voltages may be activated in sequence, such that large changes in voltage may not be needed. In one example, if the activation voltage for string 1 is greater than the activation voltage for string 2, which may be greater than the activation voltage for string 3, etc. to 8 string, then once the $V_{bus}$ was at a level to activate string 1, it may make the system more efficient to step through the various voltages for strings 1 through 8, as there would not be large changes in voltages, thereby making smaller changes in $V_{bus}$.

A single comparator and/or threshold detector may be used for each LED string, which may be capable of comparing the voltage across the current sink devices to a known threshold limit. For any voltage greater than the threshold, the current sink may maintain a near constant output current. The comparator output may change state whenever the voltage falls below the threshold, indicating that the corresponding current sink has dropped out of regulation. Detection may be performed by sweeping the power supply bus voltage from a minimum to maximum value in steps equal to the desired groups formed for dynamic voltage scaling, or in unequal steps. The outputs of the comparator may then indicate for each voltage step, the number of strings that have entered regulation. In this manner, simultaneous forward voltage detection along with ordering of strings may be performed. The detection process may be performed at startup or periodically due to the slow nature of changes in the diode forward voltages. The LED strings may then be ordered according to the desired dynamic voltage scaling waveshape, e.g. a triangle or sawtooth waveshape.

The same technique may also be used to detect LED failures. An occurrence of an open would cause sudden changes in the current sink voltage that may be easily detected from comparator outputs. On detection of failure, control action may be initiated, which may include complete shut-down or circuit techniques, which may be utilized to mitigate the failure. Such techniques may also be used during manufacturing for automated test of LED operation.

In an embodiment, it may be possible to improve the hardware utilization by using a single comparator with a MUXed function implemented at its input. The voltage detection may be performed by sweeping the output voltage once per LED string. Furthermore, the bus voltage may be swept once, with the MUX swept through each LED string at each step in the bus voltage.

Integration of the power stage controller along with dimming logic may provide opportunities for system level reduction of inefficiencies. The appropriate converter topology may depend at least in part upon the input voltage and number of LEDs per string. A boost-type topology is shown in FIG. 3, which may be appropriate for operating from a battery voltage or standardized low voltage bus. A buck-type topology may be appropriate when operating from a rectified AC line voltage. In an embodiment, digital control may be utilized to take advantage of the feed-forward and dynamic voltage scaling, which may be possible by having direct control of the load.

A variety of control strategies may be possible based at least in part upon the level of integration and interaction between the boost converter and load controllers. An embodiment may use a conventional digital boost regulator with ADC, programmable digital PID compensator and digital pulse width modulator (DPWM), with a feed-forward-type command from the LED string PS-PWM controller, as shown in FIG. 3.

The feed-forward path may be used to send the load current and required bus voltage for upcoming load changes. In an embodiment, the boost converter may ignore the load current information, and utilize feedback regulation to track the bus reference voltage command. The response of the regulation loop to reference transients needs to be faster than the LED PS-PWM period. The boost compensator may also be preloaded from look-up tables for improved performance based on the known load current change information. Another embodiment may remove the conventional boost regulation loop and ADC altogether and merge the LED and boost control. In this embodiment, the controller may rely more directly on feed-forward information with precomputed tables of boost switch timing, based at least in part upon the known load current and voltage steps. The threshold detector may be used in a slow integral loop to track changes in the input voltage or LED string voltages.

The LED luminous flux output and the junction temperature may be functions of the LED forward current. It may be essential to control LED forward current to meet the desired specifications, as well as to prevent thermal run-away. Excessive current ripple may cause thermal cycling and result in premature hardware failure. Therefore, it may be best suited to drive LEDs with a constant current, with minimum or no ripple. In the embodiment shown in FIG. 3, a linear programmable current sink is used to regulate the LED forward current to a desired level. Amplitude modulation (AM) may be achieved by programming the reference current level at which the sink regulates, while pulse width modulation may be implemented by enabling or disabling the current regulation device. The programmable linear current sink can be constructed using discrete components, or can be easily integrated on a chip. Combination of AM and PWM schemes may be then used to achieve a wide dynamic dimming ratio, which may be important to many LED lighting applications.

As the specifications are mentioned in terms of light output, it may be important to consider the LED array as an integral part of the architecture. Development of HB-LEDs may be taking place in two diverse trends, one involving high power (>1 W) large chip area LEDs (1 $mm^2$) with high flux output and others based on low-power (less than 1 W) high efficiency LEDs with moderate flux output. High-power LEDs result in fewer components, but may significantly increase the cost of optical and thermal design. The disclosed topology may be suitable for either trend, but may emphasize solutions with a relatively large number of LED strings in parallel.

Figure 4:
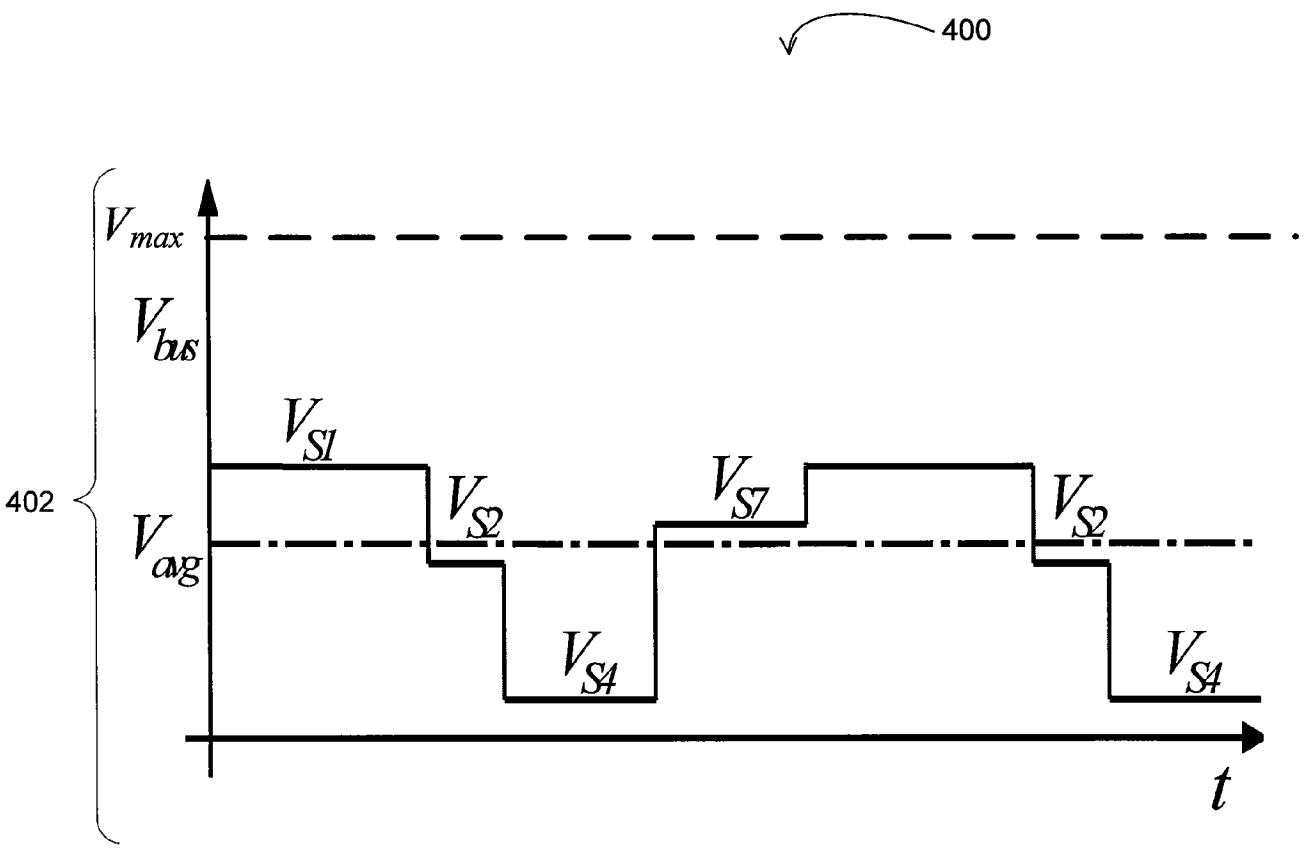
FIG. 4 is a graph of bus voltage, which may be utilized in controlling one or more light sources in accordance with one or more embodiments.

FIG. 4 shows a diagram 400 of bus voltages in an embodiment, where the activation voltages 402 for the various strings are different. $V_{max}$ shows the voltage that would need to be maintained on $V_{bus}$ if all strings were activated at 100%. As shown, the voltage of $V_{bus}$ may be controlled such that it may be kept at a relative minimum for activating various strings. As shown $V_{S1}$ would be the voltage needed to activate string 1, $V_{S2}$ may be the voltage needed to activate string 2, etc. $V_{avg}$ may be the average value of $V_{bus}$ with this system and method of controlling the bus voltage. As can be seen, $V_{bus}$ may be reduced, thereby saving power and/or reducing inefficiencies within the system. Furthermore, as shown, smaller steps in voltage may further reduce inefficiencies, such that strings with similar activation voltages may be activated near in time to each other to further reduce inefficiencies.

Since large manufacturing variations in LED forward voltage, and hence LED string voltage can be expected, dynamic bus voltage regulation may be used to improve efficiency by maintaining the bus voltage at a relative minimum value required to keep all activated LED strings in regulation. As shown in FIG. 2, the PS-PWM may continually rotate which phases are active for the input command Dim<100%. Thus, the minimum required voltage may change in time according to the active phases. For example, at two extremes: for Dim=1, all phases are on and the required bus voltage is constantly the maximum of the string voltages; for Dim=1/N, only one phase is on at a time and the required voltage tracks the forward voltage of each string.

The approach is illustrated in FIG. 4, where the forward voltage for each string is indicated as $V_{Si}$, where i is the string number. The bus voltage plot may show the dynamics of the required bus voltage for an 8-string system (N=8) with an input command Dim=40% and assumed relative magnitudes of the string voltages as shown. In this embodiment, $V_{S1}$ is dominant, followed by $V_{S2}$, $V_{S4}$ and $V_{S7}$. The average bus voltage is lower than the worst case string voltage, which may result in improved efficiency since the load current is generally the same with or without dynamic bus scaling. The efficiency improvement achieved by performing dynamic voltage scaling may be described at least in part by the equation:

$$\Delta\eta = \left(\frac{V_F - V_{avg}}{N \cdot V_F \cdot V_{avg}}\right) \cdot \sum_{i=1}^{N} V_{Si}$$

where, $V_F$ is fixed (worst-case) bus voltage being used in the comparison and $V_{avg}$ is the average bus voltage with dynamic bus voltage scaling. According to this equation, the greatest efficiency improvement may occur at a relatively low dimming command where $V_{avg}$ is minimum. The circuit requirements may be simplified while maintaining some efficiency improvement at least in part by sensing the actual maximum of the string voltages, and fixing the bus voltage to that value, as opposed to using worst-case datasheet values. This may result in a relatively slow tracking of the bus voltage that is independent of the input Dim command.

Additional reductions in inefficiencies may be achieved at low dimming levels by disabling appropriate strings, and dynamically changing the number of strings used in the PS-PWM rotation. However, this may result in a degradation in the uniformity of the light source and may not be acceptable for applications such as backlighting for LCD-TV.

Figure 5:
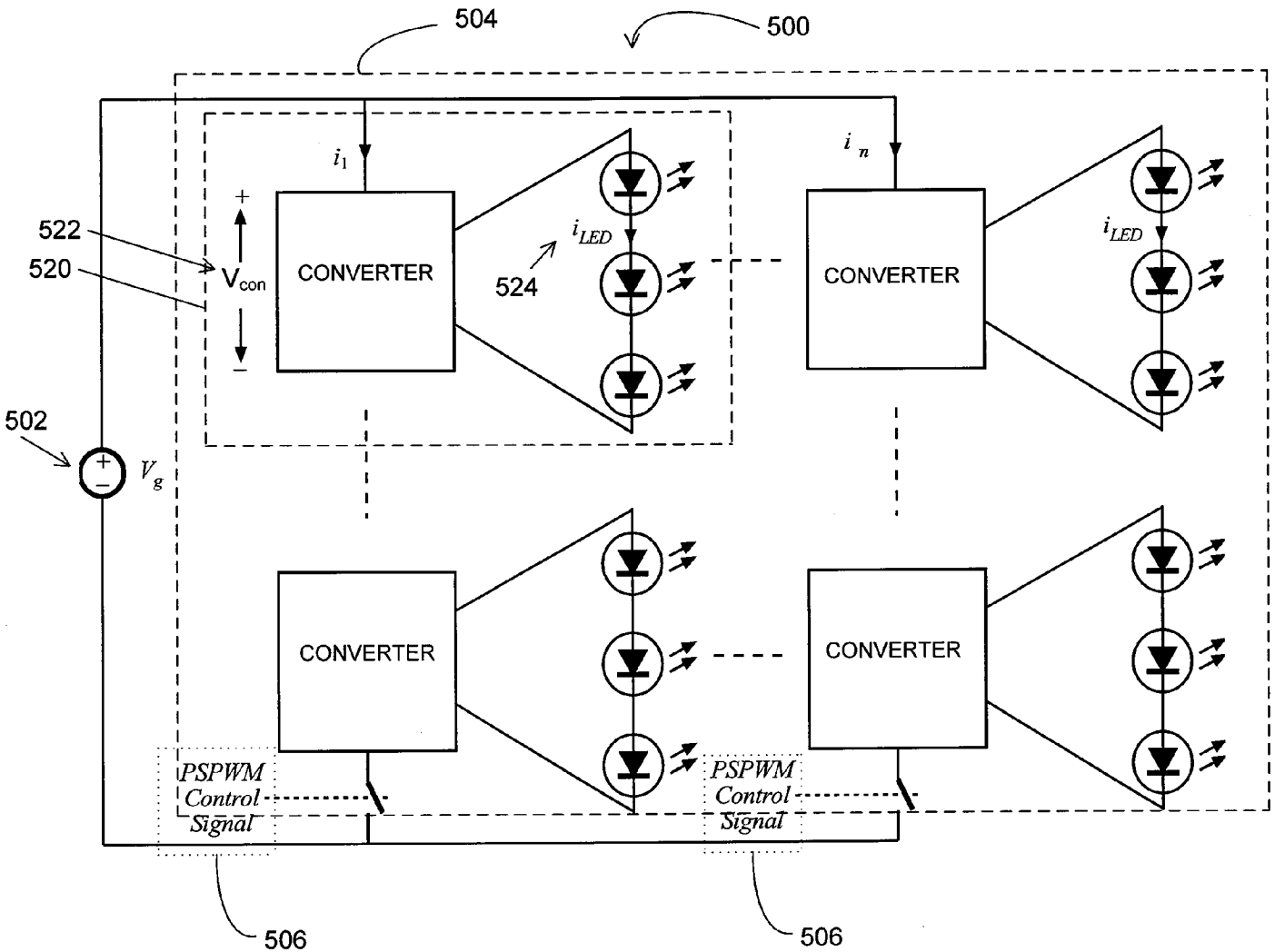
FIG. 5 is a block diagram of a system capable of controlling one or more light sources in accordance with one or more embodiments.

FIG. 5 shows a system 500 capable of controlling LEDs. System 500 may include a power source 502 connected to strings 504. Furthermore, system 500 may include control signals 506 coming from a PS-PWM (not shown).

In this embodiment, system 500 may also include a converter module 520. Converter module 520 may include a converter 522 and a string of LEDs 524. The converter may be of buck, boost and/or buck-boost, and/or combinations thereof. The configuration of converter may be based upon the type of power source 502. With this configuration, the LEDs and linear current sources of FIG. 3 may be replaced with converter modules, which may convert the power for the individual strings of LEDs. In this manner, further size constraints may be eliminated and inefficiencies of the linear current sources may also be eliminated from the system.

In this embodiment, efficiency may be improved by eliminating the need for linear current sources. The size and cost may be reduced by utilizing a relatively miniature reduced power modules that may run at high frequency, with high efficiency, and relatively miniature components. This configuration may also provide more localized control of the LEDs as there may be a smaller number of LEDs per module. Furthermore, this embodiment may be capable of providing LED failure detection and local protection by shorting failed LED modules.

With generally localized control of LED current, and with the use of pulse width modulation, binning requirement may be reduced, thereby reducing costs. In this embodiment, strings of converter modules may replace the strings of LEDs and current sources to provide bus voltage regulation and/or PS-PWM. The converter modules may be capable of regulating current and/or local light output.

Light sensors may be added to the module, as discrete components and/or integrated with the converter. The modules may be discrete or may be co-packaged and/or integrated (e.g. converter with LEDs). The converter filter inductor element may be integrated, associated with package and bonding lead inductance, and/or an external inductor. The converter filter capacitance may be integrated, associated with packaging and bonding, external, and/or the LED junction capacitance. The converter may also tune the operating frequency to control the LED current ripple, especially if the filter inductance is not well controlled. The series modules 520 may operate with the same input port current which is based on the bus voltage, LED output power, and converter efficiencies. The converters may operate to share the total bus voltage across all series modules and tune individual module $V_{con}$ to deliver the required current to the module LEDs with relatively high efficiency. Furthermore, the number of LEDs in each module may not have to be identical.

Furthermore, when the converter voltage $V_{con}$ reaches a sufficient level, the converter may control current $i_{LED}$ to the LEDs in the converter module. Furthermore, the converter may control light output of the module, and may utilize a light sensor for local feedback to regulate light output. As the voltage rises, further converter modules within the string may also be activated and controlled in this manner. Signal 506 may control the activation of the individual converters similar to the system shown in FIG. 3. With this embodiment, inefficiencies may be reduced, and/or EMI may also be reduced.

Figure 6:
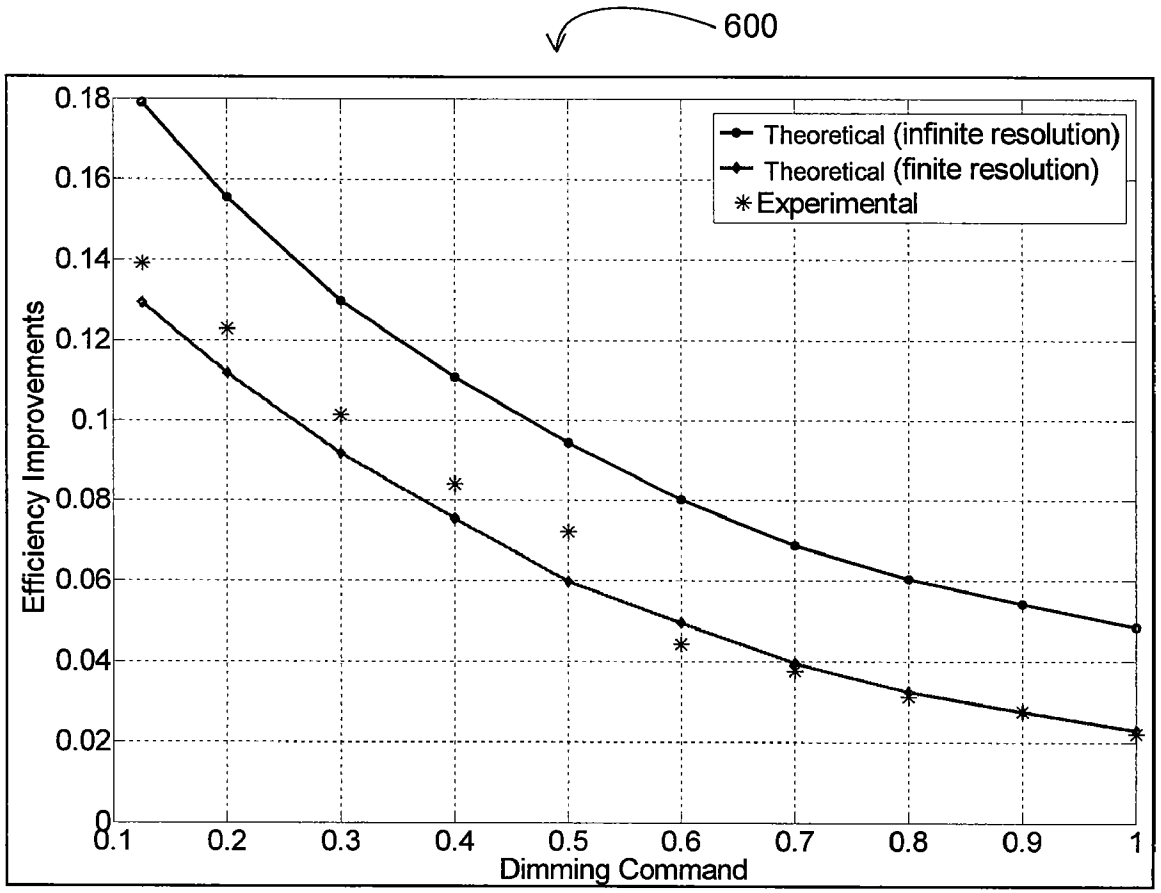
FIG. 6 is an efficiency diagram from an experimental system for controlling one or more light sources in accordance with one or more embodiments.

FIG. 6 may summarize the experimental efficiency improvement and compare it with a theoretically calculated value. The fixed bus voltage used for this comparison was 35 volts, based on worst-case data sheet values for the LEDs. Up to a 14% experimental improvement in efficiency may be observed at a duty and/or dim command of 12.5%. Overall, the experimental efficiency may be about 4% below the theoretical. This may be due to a finite number of voltage levels to group the LEDs and the rise and fall time performance of the converter wave forms.

Disclosed herein may be embodiments suitable for efficient drive of a scalable number of parallel LED strings. Inefficiencies may be reduced by combining and coordinating control of the power converter and LED strings, which may result in a system with somewhat deterministic load behavior. Uniform phase shifting of LED strings may be performed to minimize load current variations, which may result in reduced output capacitance, improved converter efficiency, and/or reduced system EMI, and/or combinations thereof. LED string voltages may be detected and used in a feedforward path for dynamic bus voltage scaling, which may result in improved system efficiency at low dimming levels. Experimental results are presented in FIG. 6 for a 15 W boost converter with FPGA based digital control driving a 64 LED array with 8 LED strings.

Figure 7:
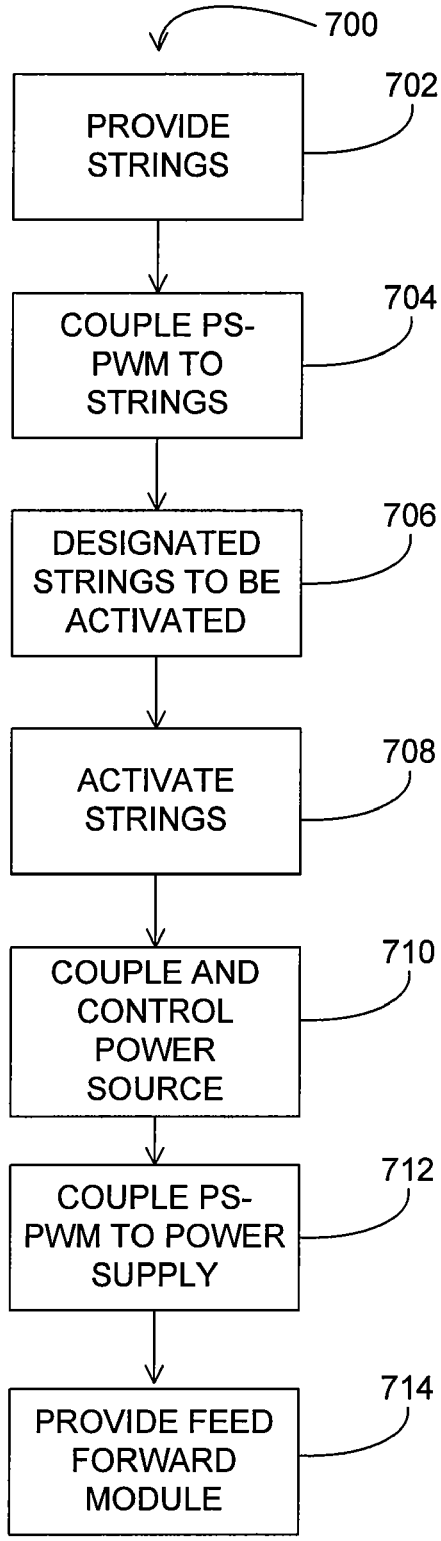
FIG. 7 is a flow diagram of a method of controlling one or more light sources in accordance with one or more embodiments.

FIG. 7 is a flow diagram of a method for controlling light sources, generally at 700. Method 700 may include providing a plurality of parallel strings of at least one series of LEDs at 702. There may be 2 or more parallel strings of at least two series of LEDs, which may be utilized to provide back lighting, among many other uses.

Method 700 may include coupling a PS-PWM to the parallel strings at 704. The PS-PWM may be capable of activating the various strings to allow them to emit light. Furthermore, at 706, the PS-PWM may designate the one or more parallel strings to be activated based, at least in part, upon an input command. The PS-PWM may designate and/or activate different strings based on the voltage drop across those strings, among many other considerations. With this configuration, the bus voltage may not need to change greatly when separate strings are activated if the PS-PWM activates strings with similar voltage drops. This would lessen the in-rush current, which would reduce inefficiencies and electromagnetic interference.

At 708 the designated strings may be activated during a time period based, at least in part, on the input command. The input command, in an embodiment, may be a dimming command, which may indicate the amount of light relative to full-on that the system may require.

At 710, the method may include coupling a power source to the plurality of strings. The power source may be a voltage source capable of providing enough power, such that the strings may be controlled. Furthermore, the PS-PWM may send a signal to the power source, indicating which strings are designated to be activated, such that the power source may be controlled to output a relatively minimum amount of power to activate the designated strings.

At 712, the PS-PWM may be coupled to the power supply and provide a control signal to the power supply to control the power output at a relative minimum. In this manner, the overall average power may be reduced relative to a full-on or max voltage bus condition. As an example, if the dim command was for 40% of 8 strings, 3 strings would be designated for activation. If the voltage across those strings is known, then similar voltage drop strings may be designated for activation, such that the power supply may not have to supply much different power levels to activate the designated strings.

At 714, a feed-forward type module may be provided and coupled to the PS-PWM and the power supply, such that the feed-forward type module may be capable of receiving signals from the PS-PWM and providing a generally feed-forward type signal to the power supply.

In an embodiment, the feed-forward type module may include a threshold detector, which may be capable of measuring the voltage drop of a string. Furthermore, the feed-forward module may include digital feedback and feed-forward control, as well as a PS-PWM. Alternatively, the feed-forward module may include an A to D converter in the place of the threshold detector to measure voltage drops. By being able to measure voltage drops, thermal conditions may be accounted for and the information may help reduce inefficiencies within the system.

The threshold detector may cycle through all strings in the very beginning to find out the voltage drop across each string and then, at set time periods, cycle through and measure the voltage changes, such that thermal characteristics may be determined, as well as failure of particular LED strings.

Furthermore, the threshold detector may be utilized to detect thermal characteristics. LED junction temperature may be tracked by measuring changes in the forward voltage drop. Forward voltage may vary by approximately −2 mV/° C. The forward voltage may be measured and stored in memory during the manufacturing and calibration phase, which then may be used as a reference during normal operation to determine the LED temperature. This information may be useful for controlling the operation of LED modules that use more than one color (example red, green and blue) to generate white light.

Some portions of this detailed description are presented in terms of processes, programs and/or symbolic representations of operations on data bits and/or binary digital signals within a computer memory, for example. These process descriptions and/or representations may include techniques used in the data processing arts to convey the arrangement of a computer system and/or other information handling system to operate according to such programs, processes, and/or symbolic representations of operations.

A process may be generally considered to be a self-consistent sequence of acts and/or operations leading to a desired result. These include physical manipulations of physical quantities. Usually, though not necessarily, these quantities take the form of electrical and/or magnetic signals capable of being stored, transferred, combined, compared, and/or otherwise manipulated. It may be convenient at times, principally for reasons of common usage, to refer to these signals as bits, values, elements, symbols, characters, terms, numbers and/or the like. However, these and/or similar terms may be associated with the appropriate physical quantities, and are merely convenient labels applied to these quantities.

Unless specifically stated otherwise, as apparent from the following discussions, throughout the specification discussion utilizing terms such as processing, computing, calculating, determining, and/or the like, refer to the action and/or processes of a computing platform such as computer and/or computing system, and/or similar electronic computing device, that manipulate and/or transform data represented as physical, such as electronic, quantities within the registers and/or memories of the computer and/or computing system and/or similar electronic and/or computing device into other data similarly represented as physical quantities within the memories, registers and/or other such information storage, transmission and/or display devices of the computing system and/or other information handling system.

The processes and/or displays presented herein are not inherently related to any particular computing device and/or other apparatus. Various general purpose systems may be used with programs in accordance with the teachings herein, or a more specialized apparatus may be constructed to perform the desired method. The desired structure for a variety of these systems may appear in the detailed description. In addition, embodiments are not described with reference to any particular programming language. It will be appreciated that a variety of programming languages may be used to implement the teachings described herein.

In the detailed description and/or claims, the terms coupled and/or connected, along with their derivatives, may be used. In particular embodiments, connected may be used to indicate that two or more elements are in direct physical and/or electrical contact with each other. Coupled may mean that two or more elements are in direct physical and/or electrical contact. However, coupled may also mean that two or more elements may not be in direct contact with each other, but yet may still cooperate and/or interact with each other. Furthermore, couple may mean that two objects are in communication with each other, and/or communicate with each other, such as two pieces of software, and/or hardware, or combinations thereof. Furthermore, the term "and/or" may mean "and", it may mean "or", it may mean "exclusive-or", it may mean "one", it may mean "some, but not all", it may mean "neither", and/or it may mean "both", although the scope of claimed subject matter is not limited in this respect.

Although the claimed subject matter has been described with a certain degree of particularity, it should be recognized that elements thereof may be altered by persons skilled in the art without departing from the spirit and/or scope of claimed subject matter. It is believed that the subject matter pertaining to controlling light sources and/or many of its attendant utilities will be understood by the forgoing description, and it will be apparent that various changes may be made in the form, construction and/or arrangement of the components thereof without departing from the scope and/or spirit of the claimed subject matter or without sacrificing all of its material advantages, the form herein before described being merely an explanatory embodiment thereof, and/or further without providing substantial change thereto. It is the intention of the claims to encompass and/or include such changes.

The invention claimed is:

1. A system for controlling multiple LEDs, comprising:

one or more parallel strings of one or more series LED(s);

a voltage source capable of providing voltage to the parallel strings; and a phase shifted pulse width modulator capable of designating strings to be activated based at least in part upon an input command, wherein a percentage of the parallel strings are activated during a time period based at least in part upon the input command, wherein the voltage source further comprises a power supply, wherein the power supply is capable of outputting a relatively minimum power to activate the percentage of the parallel strings, wherein the phase shifted pulse width modulator is coupled to the power supply, wherein the phase shifted pulse width modulator is capable of providing a control signal to the power supply, wherein the power supply output is based at least in part upon the control signal from the phase shifted pulse width modulator, and wherein efficiency improvement due to voltage scaling may be described by:

$$\Delta\eta = \left(\frac{V_F - V_{avg}}{N \cdot V_F \cdot V_{avg}}\right) \cdot \sum_{i=1}^{N} V_{Si}.$$

2. The system according to claim 1, further comprising a threshold detector for dynamically sensing changes in voltage requirements of the LED strings.

3. The system according to claim 1, further comprising:

a feed-forward-type module coupled to the one or more strings, to the phase shifted pulse width modulator, and to the power supply, capable of receiving signals from the phase shifted pulse width modulator, and providing feed-forward-type signals to the power supply.

4. The system according to claim 3, wherein the feed-forward-type module is capable of indicating the voltage drop of at least one of the parallel strings.

5. The system according to claim 4, wherein the voltage drop is utilized to approximate temperature change of the LEDs.

6. The system according to claim 3, wherein the feed-forward-type module is capable of detecting a failure within at least one of the parallel strings.

7. A system for controlling multiple LEDs, comprising:

one or more parallel strings of one or more series LED(s);

a voltage source capable of providing voltage to the parallel strings;

a phase shifted pulse width modulator capable of designating strings to be activated based at least in part upon an input command, wherein a percentage of the parallel strings are activated during a time period based at least in part upon the input command; and a threshold detector configured to dynamically sense a maximum voltage value of the strings and fix a bus voltage to the dynamically sensed maximum voltage value of the strings, wherein the voltage source further comprises a power supply, wherein the power supply is capable of outputting a relatively minimum power to activate the percentage of the parallel strings, wherein the phase shifted pulse width modulator is coupled to the power supply, wherein the phase shifted pulse width modulator is capable of providing a control signal to the power supply, wherein the power supply output is based at least in part upon the control signal from the phase shifted pulse width modulator.

8. The system according to claim 7, wherein the threshold detector is configured for dynamically sensing changes in voltage requirements of the LED strings.

9. The system according to claim 7, further comprising:

a feed-forward-type module coupled to the one or more strings, to the phase shifted pulse width modulator, and to the power supply, capable of receiving signals from the phase shifted pulse width modulator, and providing feed-forward-type signals to the power supply.

10. The system according to claim 9, wherein the feed-forward-type module is capable of indicating the voltage drop of at least one of the parallel strings.

11. The system according to claim 10, wherein the voltage drop is utilized to approximate temperature change of the LEDs.

12. The system according to claim 9, wherein the feed-forward-type module is capable of detecting a failure within at least one of the parallel strings.

* * * * *